US012339089B2

(12) United States Patent
Schlosser et al.

(10) Patent No.: US 12,339,089 B2
(45) Date of Patent: Jun. 24, 2025

(54) LINE LAUNCHERS

(71) Applicant: Milwaukee Electric Tool Corporation, Brookfield, WI (US)

(72) Inventors: Drake J. Schlosser, Hartford, WI (US); Luke A. Meyer, Milwaukee, WI (US); Michael Steven Van Dyke, Wauwatosa, WI (US); Anthony J. Buxton, Wauwatosa, WI (US); Jacob M. Teitler, Milwaukee, WI (US); Shane L. McCue, Greenfield, WI (US); Daniel D. Crane, West Allis, WI (US); Seamus Joseph Doyle Herson, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 121 days.

(21) Appl. No.: 18/460,032

(22) Filed: Sep. 1, 2023

(65) Prior Publication Data

US 2024/0077277 A1 Mar. 7, 2024

Related U.S. Application Data

(60) Provisional application No. 63/403,577, filed on Sep. 2, 2022.

(51) Int. Cl.

| | |
|---|---|
| ***F41B 11/80*** | (2013.01) |
| ***F41B 11/62*** | (2013.01) |
| ***F41B 11/71*** | (2013.01) |
| ***F41B 11/723*** | (2013.01) |
| ***F42B 12/68*** | (2006.01) |

(52) U.S. Cl.
CPC ..... *F41B 11/80* (2013.01); *F41B 11/62* (2013.01); *F41B 11/71* (2013.01); *F41B 11/723* (2013.01); *F42B 12/68* (2013.01)

(58) Field of Classification Search
CPC ..... F41B 11/83; F41B 11/80; F41B 11/62; F41B 11/68
See application file for complete search history.

(56) References Cited

U.S. PATENT DOCUMENTS

| | | | | | |
|---|---|---|---|---|---|
| 2,090,731 | A * | 8/1937 | Klein | F41B 11/68 | 43/6 |
| 2,111,374 | A * | 3/1938 | Sedgley | F42B 12/68 | 102/504 |
| 2,642,056 | A * | 6/1953 | Harris | F41B 11/00 | 124/83 |
| 3,056,395 | A * | 10/1962 | Merz | F41B 11/62 | 124/31 |
| 3,142,293 | A * | 7/1964 | James | F41B 11/83 | 124/40 |
| 3,420,220 | A * | 1/1969 | Juan | F41B 11/724 | 124/71 |

(Continued)

*Primary Examiner* — Derrick R Morgan
(74) *Attorney, Agent, or Firm* — Dority & Manning, P.A.

(57) ABSTRACT

A line launcher includes a launcher body extending along a longitudinal axis between a rear end and a front end. The line launcher further includes a handle, a trigger, and a removable battery. The line launcher further includes a compressed gas charge assembly. The line launcher further includes an elongated barrel coupled to the body at the front end. The line launcher further includes a throwline assembly, the throwline assembly including a projectile and a throwline, the projectile insertable into and ejectable from the elongated barrel.

18 Claims, 4 Drawing Sheets

(56) References Cited

U.S. PATENT DOCUMENTS 3,780,720 A * 12/1973 Alderson ..... F41B 11/723 124/31
4,077,349 A * 3/1978 Paul ..... B63B 21/00 114/230.25
5,460,155 A * 10/1995 Hobbs ..... F42B 12/68 124/56
5,699,780 A * 12/1997 Bissonnette ..... F41B 11/83 124/73
6,244,261 B1 * 6/2001 West, Jr. ..... F41B 11/62 102/504
6,857,422 B2 * 2/2005 Pedicini ..... F04B 9/02 124/63
10,900,740 B1 * 1/2021 Casto, Jr. ..... F41B 11/723
2004/0069291 A1 * 4/2004 May ..... F41B 11/83 124/17
2004/0173197 A1 * 9/2004 Moffitt ..... F41B 11/83 124/74
2006/0059764 A1 * 3/2006 Triano ..... A01K 91/02 43/19
2016/0376029 A1 * 12/2016 Sekiya ..... B64F 1/0295 244/110 F
2017/0115091 A1 * 4/2017 Henson ..... F41B 7/003
2021/0140737 A1 * 5/2021 Malheiros ..... F41B 11/723
2023/0251056 A1 * 8/2023 Witzigreuter ..... F41B 11/681 124/56
2024/0011733 A1 * 1/2024 Malheiros ..... F41B 11/83
2024/0077277 A1 * 3/2024 Schlosser ..... F41B 11/80

* cited by examiner

LINE LAUNCHERS

CROSS-REFERENCE TO RELATED APPLICATIONS

The present application claims priority to U.S. Provisional Patent Application 63/403,577 filed on Sep. 2, 2022 the disclosure of which is incorporated by reference herein in its entirety.

FIELD

The present disclosure relates generally to power tools, such as handheld power tools, and more particularly to line launchers for use by arborists and other end users.

BACKGROUND

Many industries utilize throwlines to, for example, access certain areas, set up certain equipment such as climbing equipment, etc. One particular industry that utilizes throwlines is the arborist industry. Arborists routinely utilize throwlines to set their climbing or rigging lines on trees to be accessed. Other professionals which utilize throwlines include fire fighters, rescue workers, and landscaping professionals.

Currently known throwline assemblies suffer from a number of disadvantages. For example, many known throwline assemblies utilize a weight and a line, with the weight being manually tossed. These assemblies are inaccurate, can be easily tangled, and are inefficient to utilize. Other throwline assemblies utilize a slingshot type apparatus to throw the weight. However, these assemblies suffer from similar deficiencies; inaccuracy, tangling, and inefficiencies.

Some pneumatic assemblies have been developed to more easily project the throwline weight to a desired distance. However, these assemblies still do not address tangling issues and other inefficiencies associated with other throwline assemblies.

Accordingly, improved methods and apparatus for deploying throwlines are desired in the art. In particular, methods and apparatus which reduce tangling issues and are relatively more efficient to use would be advantageous.

BRIEF DESCRIPTION

Aspects and advantages of the invention in accordance with the present disclosure will be set forth in part in the following description, or may be obvious from the description, or may be learned through practice of the technology.

In accordance with one embodiment, a line launcher is provided. The line launcher includes a launcher body extending along a longitudinal axis between a rear end and a front end. The line launcher further includes a handle, a trigger, and a removable battery. The line launcher further includes a compressed gas charge assembly. The line launcher further includes an elongated barrel coupled to the body at the front end. The line launcher further includes a throwline assembly, the throwline assembly including a projectile and a throwline, the projectile insertable into and ejectable from the elongated barrel.

In accordance with another embodiment, a line launcher is provided. The line launcher includes a launcher body extending along a longitudinal axis between a rear end and a front end. The line launcher further includes a handle, a trigger, and a removable battery. The line launcher further includes a compressed gas charge assembly. The line launcher further includes an elongated barrel coupled to the body at the front end. The line launcher further includes a throwline assembly, the throwline assembly comprising a projectile, a throwline, a reel, and a throwline container, the projectile insertable into and ejectable from the elongated barrel, the reel mounted to the body proximate the front end.

In accordance with another embodiment, a method for deploying a throwline assembly is provided. The method may include obtaining a desired launch range; obtaining a desired launch pressure; setting a desired launch pressure; achieving a desired launch pressure; deploying a throwline assembly; and/or gathering a throwline.

These and other features, aspects and advantages of the present invention will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present invention, including the best mode of making and using the present systems and methods, directed to one of ordinary skill in the art, is set forth in the specification, which makes reference to the appended figures, in which.

DETAILED DESCRIPTION

Figure 1:
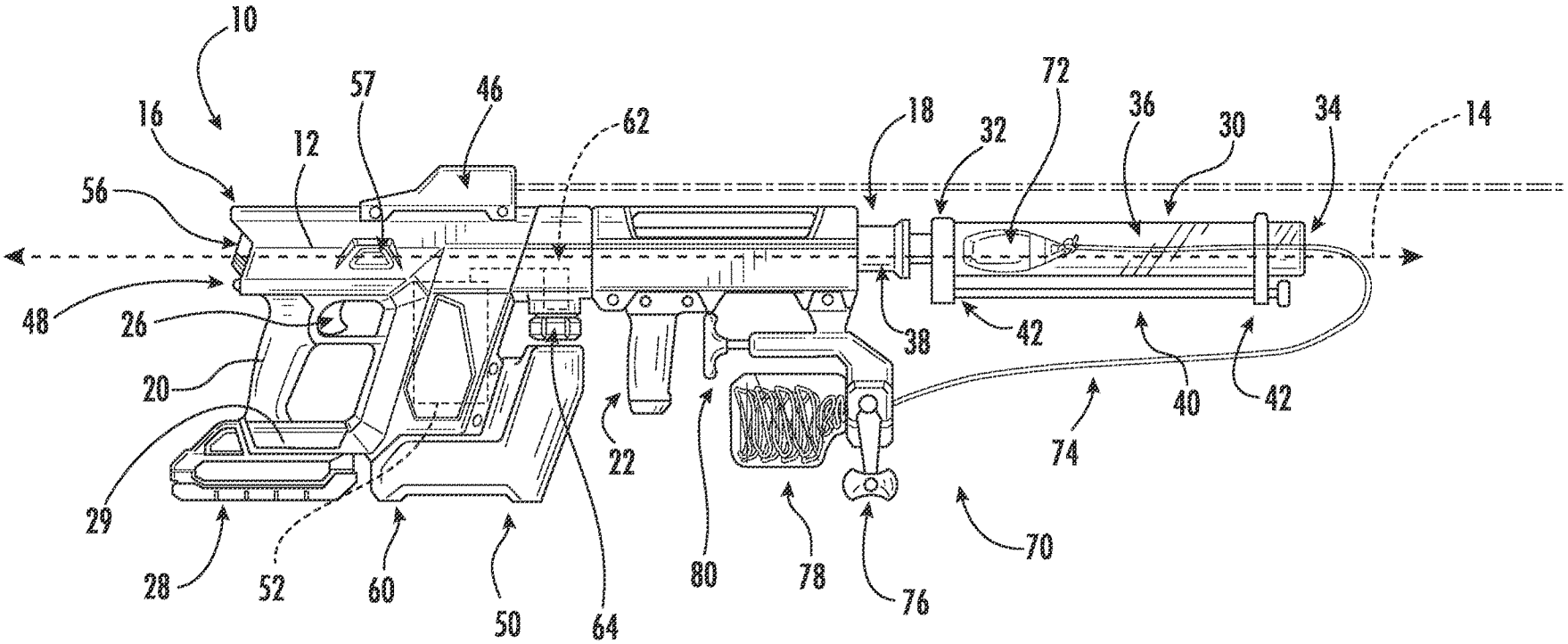
FIG. 1 illustrates a line launcher in accordance with embodiments of the present disclosure.

Reference now will be made in detail to embodiments of the present invention, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including" "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive—or and not to an exclusive—or. For example, a condition A or B is satisfied by any one of the following: A is true (or present) and B is false (or not present), A is false (or not present) and B is true (or present), and both A and B are true (or present).

Terms of approximation, such as "about," "generally," "approximately," "proximate", or "substantially," include values within fifteen percent greater or less than the stated value. When used in the context of an angle or direction, such terms include within fifteen degrees greater or less than the stated angle or direction. For example, "generally vertical" includes directions within fifteen degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

In general, the present disclosure is directed to improved line launchers and methods for using line launchers. Line launchers and methods in accordance with the present disclosure advantageously provide for more efficient and accurate launching of throwlines. Advantageously, arborists and other professionals can utilize such line launchers and methods to more efficiently and accurately launch throwlines, thus resulting in improvements in their job performance quality and timeliness. Line launchers in accordance with the present disclosure may advantageously include, for example, features which provide improved range measurement and calibration, and may additionally or alternatively include improved features which reduce line tangling issues.

Figure 6:
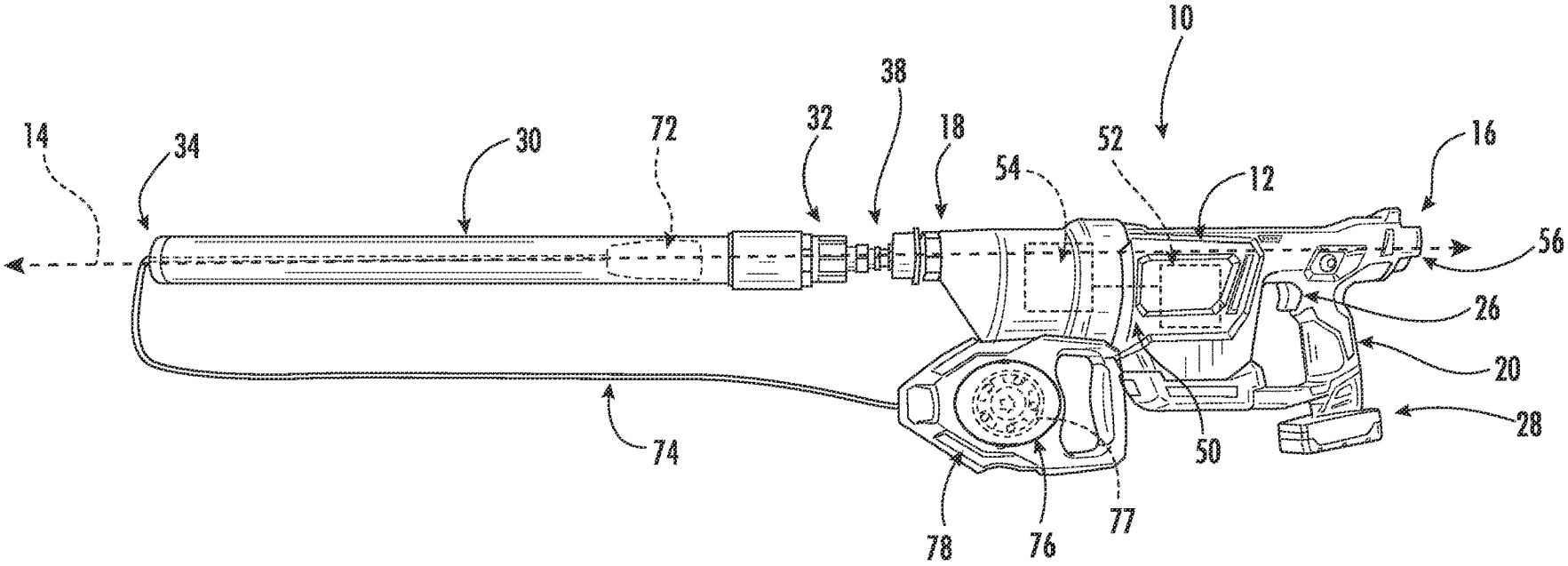
FIG. 6 illustrates a line launcher in accordance with other embodiments of the present disclosure.

Referring now to the drawings, FIGS. 1 and 6 illustrate line launchers 10 in accordance with various embodiments of the present disclosure. A line launcher 10 may, for example, include a launcher body 12. Launcher body 12 may extend along a longitudinal axis 14 between a rear end 16 and a front end 18. Body 12 may further be sized to house various other components of the line launcher 10.

Line launcher 10 may further include one or more handles. For example, a first handle 20 may be provided, and may be connected to or integral with the body 12. The first handle 20 may, for example, be a rear handle, and may thus be disposed proximate the rear end 16 along the longitudinal axis 14. In some embodiments, as illustrated in FIG. 1, a second handle 22 may be provided, and may be connected to or integral with the body 12. The second handle 22 may, for example, be a front handle, and may thus be disposed between the first handle 20 and the front end 18 along the longitudinal axis 14. In some embodiments, the second handle 22 may be disposed proximate a midpoint of the body 12 along the longitudinal axis 14 or between the midpoint and the front end 18. The use of two handles, and the positioning thereof, may advantageously allow a user to comfortably hold and accurately aim the line launcher 10.

A line launcher 10 in accordance with the present disclosure may further include a trigger 26. Trigger 26 may be activable by a user to launch a projectile, as discussed herein. More specifically, trigger 26 may be activated by a user to activate a compressed gas charge assembly, resulting in a blast of compressed gas to launch a projectile. Trigger 26 may, for example, be movably coupled to a handle, such as first handle 20, or body 12.

In exemplary embodiments, line launchers 10 in accordance with the present disclosure are electrically operated. For example, in exemplary embodiments, line launchers 10 may include one or more batteries 28. Each battery 28 may, for example, be a removable battery 28 that is removable from the line launcher for, for example, recharging purposes. Each removable battery 28 may be removably coupled to the line launcher at a battery interface 29. Battery interface 29 may, for example, be provided on a handle, such as first handle 20, or body 12. Accordingly, a battery 28 may be removable coupled to a handle, such as first handle 20, or body 12. In particular, in some embodiments, battery 28 may be removably coupled to the first handle 20. Because the first handle 20 is located proximate the rear end 16 of the line launcher 10, the battery location may facilitate improved balancing and ease of use of the line launcher 10, thus resulting in improved accuracy.

When connected, batteries 28 may provide power to the line launcher 10, by for example being in communication with the compressed gas charge assembly and/or trigger 26 to power such components.

A line launcher 10 in accordance with embodiments of the present disclosure may further include an elongated barrel 30. Utilization of an elongated barrel 30 as discussed herein may advantageously facilitate improved accuracy during use of such line launchers 10. Barrel 30 may be coupled to the body 12 at the front end 18 thereof. Barrel 30 may extend between a rear end 32 and a front end 34, and may define a hollow interior 36. Rear end 32 may be disposed proximate front end 18, and front end 34 may be spaced from front end 18 such that rear end 32 is between front end 18 and front end 34, along the longitudinal axis 14.

The barrel 30 may further be in communication with the compressed gas charge assembly, such as to receive compressed gas from the compressed gas charge assembly. For example, the rear end 32 may be open and in communication with the compressed gas charge assembly. The front end 34 may be open to receive a projectile and to allow such projectile to be exhausted therefrom.

In exemplary embodiments, the elongated barrel 30 may be removably coupled to the body 12 at the front end 18. For example, a coupler 38, such as a quick disconnect coupler, threaded coupler, etc., may be disposed at the front end 18 to removably couple the elongated barrel 30 to the body 12. The barrel 30 may include components, such as quick disconnect features or threads, to removable mate with the coupler 38. Such removable coupling also allows for elongated barrels 30 having varying diameters and/or lengths to be removably coupled to the body 12. One or more barrels 30 can thus be included with a line launcher 10, and a different barrel 30 can be utilized depending on the size of the projectile to be utilized, the distance that the projectile is to be thrown, and other suitable factors.

In some embodiments, a line launcher 10 may further include a ram rod 40. The ram rod 40 may be removably coupled to the line launcher 10, and may be utilized to push the projectile into the elongated barrel 30, such as towards and/or to the rear end 32. In some embodiments, ram rod 40 may be removably mounted to the body 12. Alternatively, as illustrated in FIG. 1, the ram rod may be removably mounted to the elongated barrel 30. For example, one or more mount bands 42 may be provided on the elongated barrel 30, and the ram rod 40 may be removable mounted to the mount band(s) 42.

In some embodiments, as illustrated in FIG. 1, the barrel 30 or a portion thereof may be translucent or transparent. This advantageously allows a user to visualize the location of a projectile in the barrel 30, such that the user can seat the projectile in a desired location with the barrel 30 (e.g. proximate the rear end 32) for optimal performance.

In some embodiments, a laser sight 46 may be provided in a line launcher 10. Laser sight 46 may include a laser, and may in some embodiments further include processing apparatus suitable to measure a distance based on the location at which the laser contacts an object such as a tree. The laser may be formed from visible or invisible wavelength light. Laser sight 46 may be disposed on body 12. In exemplary embodiments, laser sight 46 may be activated to measure a distance to a desired object to which a projectile is to be thrown. Further, in exemplary embodiments, laser sight 46 may be activated to accurately aim the line launcher 10 during deployment of the projectile. An activator 48 may turn the laser sight 46 on and off. The activator 48 may be in communication with the laser sight 46, and may be disposed on the laser sight 46 or at another suitable location, such as in exemplary embodiments at the rear end 16 or another ergonomic location on the body 12.

A line launcher 10 in accordance with embodiments of the present disclosure may further include a compressed gas charge assembly 50. Assembly 50 may include components to deploy blasts of compressed gas. The compressed gas may be exhausted from the assembly 50 through the front end 18 into and through the elongated barrel 30. Such blasts may thus be utilized to launch projectiles from the barrel 30 and line launcher 10 generally.

For example, in some embodiments, as illustrated in FIG. 6, a compressed gas charge assembly 50 may include a motor 52, and may further include a compressor 54. Motor 52 and compressor 54 may, for example, be housed in body 12. Motor 52 and compressor 54 may be in communication with battery 28 and trigger 26. For example, motor 52 and compressor 54 may be powered by battery 28, and may be activatable by trigger 26. Motor 52 may generally operate compressor 54, and compressor 54 may operate to compress gas (such as, for example, ambient air) and release the compressed gas to the elongated barrel 30.

In some embodiments, assembly 50 may further include a pressure adjustor 56. Pressure adjustor 56 may be in communication with the compressor 54, and may be adjustable to adjust the pressure to which the gas is being compressed by the compressor 54. A user may advantageously adjust the pressure adjustor 56 in order adjust the resulting distance that a projectile travels when fired from the line launcher 10.

For example, in other embodiments, as illustrated in FIG. 1, a compressed gas charge assembly 50 may include a motor 52, and may further include a compressed gas tank 60 and a valve 62. Compressed gas tank 60 may be coupled to the body 12, such as removably coupled to the body 12, via a suitable coupler 64. Motor 52 and valve 62 may, for example, be housed in body 12. Motor 52 and valve 62 may be in communication with battery 28 and trigger 26. For example, motor 52 and valve 62 may be powered by battery 28, and may be activatable by trigger 26. Motor 52 may generally operate valve 62, and valve 62 may operate to release the compressed gas from the compressed gas tank 60 to the elongated barrel 30.

In some embodiments, assembly 50 may further include a pressure adjustor 56. Pressure adjustor 56 may be in communication with the valve 62, and may be adjustable to adjust the pressure to which the gas is being released from the compressed gas tank 60. A user may advantageously adjust the pressure adjustor 56 in order adjust the resulting distance that a projectile travels when fired from the line launcher 10.

In some embodiments, assembly 50 may further include a pressure level activator 57. Pressure activator 57 may be in communication with the pressure adjustor 56 and valve 62, and may control the valve 62 to adjust the pressure to which the gas is being released from the compressed gas tank 60 based on the desired pressure set by the pressure adjustor 56. Accordingly, after setting of the pressure adjustor 56 to a desired pressure, the pressure activator 57 may be activated to charge the tank 60 and/or operate the valve 62 such that compressed air released from the tank 60 is at a desired pressure.

In some exemplary embodiments, the compressed air tank 60 is disposed between the first handle 20 and second handle 22 along the longitudinal axis 14. Such location advantageously provides improved balance to the line launcher, thus increasing accuracy.

A line launcher 10 in accordance with the present disclosure may further include a throwline assembly 70. Throwline assembly 70 may include a projectile 72 and a throwline 74. The throwline 74 may be connected at one end thereof to the projectile 72. The projectile 72 may be insertable into the elongated barrel 30. For example, to load the projectile for use, a user may insert the projectile into the elongated barrel 30 through the front end 34 thereof. The projectile 72 may further be inserted through the interior 36 and may, for example, be inserted to proximate the rear end 32. In some embodiments, ram rod 40 may be utilized to assist with loading of the projectile 72.

The projectile 72 may further be ejectable from the elongated barrel 30. For example, a user may activate the gas charge assembly 50 to cause a blast of compressed gas to be sent into and through the elongated barrel 30. This blast may cause ejection of the projectile 72 from the elongated barrel 30, such as via the front end 34 thereof. Further, as discussed, the pressure of the compressed gas blast may be adjusted by the user, such as via pressure adjustor 56 and/or pressure activator 57. Different pressure levels may be calibrated to different ranges of travel distances for the projectile 72, such that the user can set the pressure of the compressed gas blast such that the projectile 72 travels a desired distance from the line launcher 10 when ejected.

In some embodiments, throwline assembly 70 further includes a reel 76 and a throwline container 78. In some embodiments, the reel 76 may be a component of the throwline container 78, such that at least a portion of the reel 76 is disposed within the container 78, as illustrated in FIG. 6. Alternatively, the reel 76 may be separate from the throwline container 78, as illustrated in FIG. 1. The reel 76 and/or throwline container 78 may in exemplary embodiments be mounted to the body 12, such as proximate the front end 18. The reel 76 may advantageously accommodate portions of the throwline 74, including the end opposite the end that is connected to the projectile 72. The reel 76 may facilitate gathering of the throwline 74 into the container 78 after it has exited the container, such as after the projectile 72 is launched from the line launcher 10. Use of a reel 76 and container 78 may advantageously reduce tangling issues and increases efficiency during use of a line launcher 10.

In some embodiments, reel 76 may further advantageously include a one-way clutch 77 and/or suitable gearing to facilitate efficient and effective advancement and gathering of the throwline 74.

In some embodiments, the reel 76 may be a manual reel 76 which is wound by a user to gather the throwline 74. Alternatively, reel 76 may be motorized, and gathering may be performed automatically or upon user activation.

In some embodiments, as illustrated in FIG. 1, throwline assembly 70 may further include a brake 80. The brake 80 may be connected to the reel 76 and/or throwline 74, and may advantageously be utilized to stop advancement of the throwline 74 and projectile 72 after the projectile 72 is launched. In some embodiments, the brake 80 may be a manual brake 80 which is activated by the user. Alternatively, brake 80 may be motorized, and braking may be performed automatically or upon user activation.

A line launcher 10 in accordance with the present disclosure may further include other features which may advantageously increase the accuracy and efficiency of use and/or reduce the various disadvantages of known throwline apparatus.

For example, the line launcher 10 may include additional sensors which measure, for example, air density, temperature, humidity, projectile weight, target height, target distance, etc. The sensors may communicate with the gas charge assembly 50 such that the compressed gas pressure is optimally calibrated to project the projectile 72 a desired distance.

In some embodiments, line launcher 10 may further include processing apparatus which is in communication with, for example, a computing device such as a mobile phone or computer. For example, the line launcher 10 may provide information to or receive information from a suitable application loaded on a computing device.

In some embodiments, line launcher 10 may include other advantageous features such as weight breakaway features, a carrying handle, etc.

Figure 2:
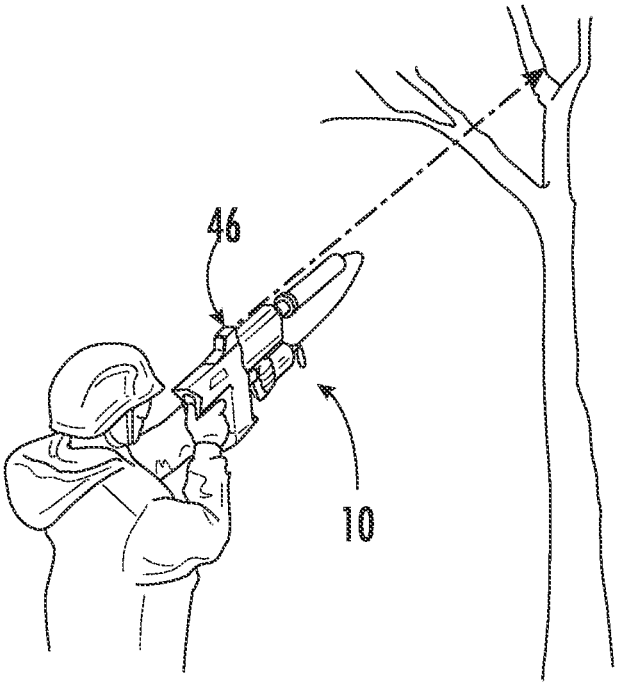
FIG. 2 illustrates use of a line launcher to obtain a desired launch range in accordance with embodiments of the present disclosure.

Referring now to FIGS. 2 through 5, the present disclosure is further directed to methods for deploying throwline assemblies 70. As shown in FIG. 2, a method may include, for example, obtaining a desired launch range. The launch range may be obtained by, for example, utilizing the laser sight 46 and/or other suitable sensors of a line launcher 10.

Figure 3:
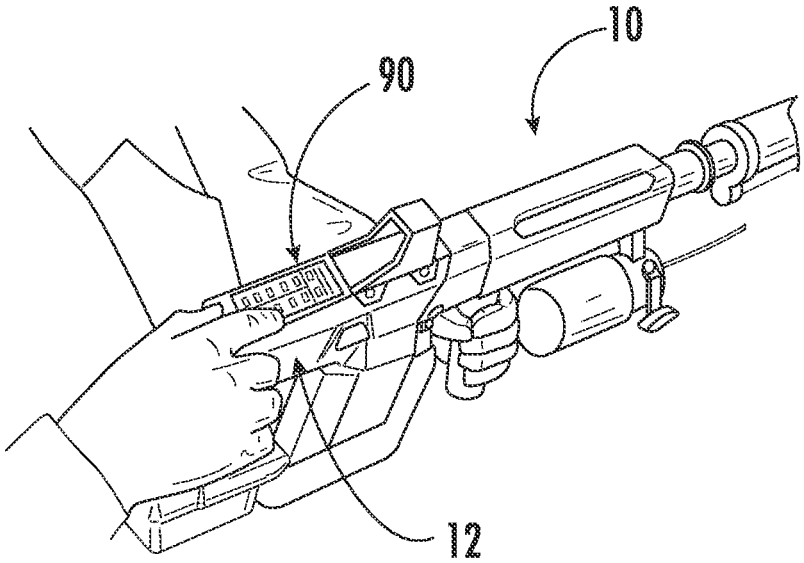
FIG. 3 illustrates use of a line launcher to obtain a desired launch pressure in accordance with embodiments of the present disclosure.

As shown in FIG. 3, a method may include, for example, obtaining a desired launch pressure. The launch pressure may be obtained, for example, based on feedback from the laser sight 46 and/or other suitable sensors. For example, laser sight 46 may provide feedback which includes a distance to a desired target. A correlation table 90 may be provided, such as on the body 12 of or programmed into the line launcher 10, which may correlate the distance to a pressure level. The user may thus utilize the correlation table 90 to obtain a desired launch pressure which correlates with a desired distance.

Figure 4:
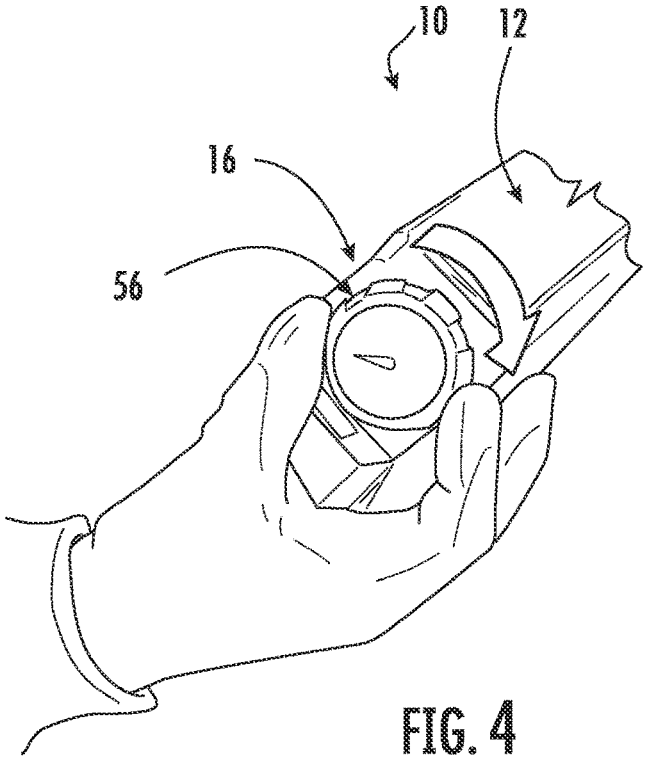
FIG. 4 illustrates use of a line launcher to set a desired launch pressure in accordance with embodiments of the present disclosure.

As shown in FIG. 4, a method may include, for example, setting a desired launch pressure. The launch pressure may be set by, for example, adjusting the gas charge assembly 50, such as via the pressure adjustor 56, based on the desired launch pressure.

Figure 5:
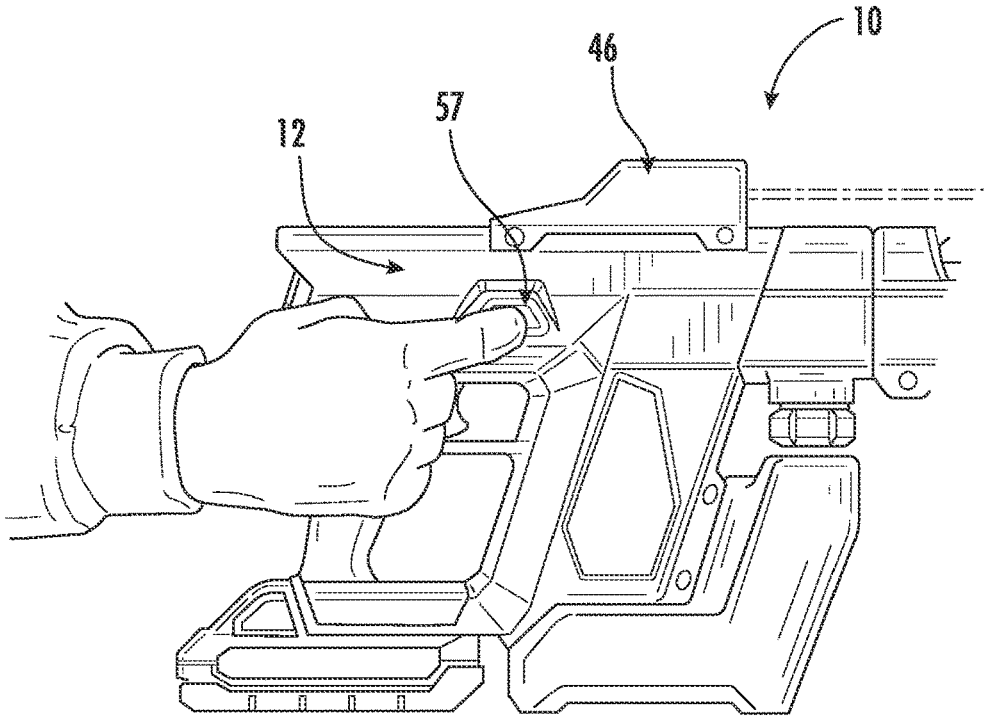
FIG. 5 illustrates use of a line launcher to achieve a desired launch pressure in accordance with embodiments of the present disclosure.

As shown in FIG. 5, a method may include, for example, achieving a desired launch pressure. The launch pressure may be set by, for example, activating the gas charge assembly 50, such as via the pressure activator 57 or compressor 54, as discussed herein.

A method may further include, for example, deploying the throwline assembly 70. For example, the trigger 26 may be activated by the user to deploy the throwline assembly as discussed herein, thus deploying the projectile 72 and throwline 74.

A method may further include, for example, gathering the throwline 74. For example, the reel 76 and container 78 may be utilized by the user to gather excess throwline 74 after a deployment.

Further aspects of the invention are provided by one or more of the following embodiments:

A line launcher which includes a launcher body extending along a longitudinal axis between a rear end and a front end; a handle; a trigger, a removable battery; a compressed gas charge assembly; an elongated barrel coupled to the body at the front end; and a throwline assembly, the throwline assembly including a projectile and a throwline, the projectile insertable into and ejectable from the elongated barrel.

A line launcher in accordance with one or more embodiments shown or described herein, wherein the elongated barrel is removably coupled to the body at the front end.

A line launcher in accordance with one or more embodiments shown or described herein, wherein the removable battery is removably coupled to the handle.

A line launcher in accordance with one or more embodiments shown or described herein, wherein the compressed gas charge assembly comprises a motor, a compressor, and a pressure adjustor.

A line launcher in accordance with one or more embodiments shown or described herein, wherein the compressed gas charge assembly comprises a motor, a compressed gas tank, a valve, a pressure level activator and a pressure adjustor.

A line launcher in accordance with one or more embodiments shown or described herein, wherein the throwline assembly further comprises a reel and a throwline container.

A line launcher in accordance with one or more embodiments shown or described herein, wherein the reel is mounted to the body proximate the front end.

A line launcher in accordance with one or more embodiments shown or described herein, wherein the throwline assembly further comprises a brake.

A line launcher in accordance with one or more embodiments shown or described herein, wherein the handle is a first handle and further comprising a second handle.

A line launcher in accordance with one or more embodiments shown or described herein, wherein the first handle is disposed proximate the rear end and the second handle is disposed between the first handle and the front end along the longitudinal axis.

A line launcher in accordance with one or more embodiments shown or described herein, further comprising a laser sight mounted to the body.

A line launcher in accordance with one or more embodiments shown or described herein, further comprising a ram rod removably coupled to the elongated barrel.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A line launcher, the line launcher comprising:

a launcher body extending along a longitudinal axis between a rear end and a front end;

a handle;

a trigger;

a removable battery;

a compressed gas charge assembly, wherein the compressed gas charge assembly comprises a motor, a compressor, and a pressure adjustor, wherein the motor is powered by the battery;

an elongated barrel coupled to the body at the front end; and a throwline assembly, the throwline assembly comprising a projectile and a throwline, the projectile insertable into and ejectable from the elongated barrel.

2. The line launcher of claim 1, wherein the elongated barrel is removably coupled to the body at the front end.

3. The line launcher of claim 1, wherein the removable battery is removably coupled to the handle.

4. The line launcher of claim 1, wherein the compressed gas charge assembly comprises a motor, a compressed gas tank, a valve, a pressure level activator and a pressure adjustor.

5. The line launcher of claim 1, wherein the throwline assembly further comprises a reel and a throwline container.

6. The line launcher of claim 5, wherein the reel is mounted to the body proximate the front end.

7. The line launcher of claim 1, wherein the throwline assembly further comprises a brake.

8. The line launcher of claim 1, wherein the handle is a first handle and further comprising a second handle.

9. The line launcher of claim 8, wherein the first handle is disposed proximate the rear end and the second handle is disposed between the first handle and the front end along the longitudinal axis.

10. The line launcher of claim 1, further comprising a laser sight mounted to the body.

11. The line launcher of claim 1, further comprising a ram rod removably coupled to the elongated barrel.

12. A line launcher, the line launcher comprising:

a launcher body extending along a longitudinal axis between a rear end and a front end;

a handle;

a trigger;

a removable battery;

a compressed gas charge assembly;

an elongated barrel coupled to the body at the front end; and a throwline assembly, the throwline assembly comprising a projectile, a throwline, a reel, a throwline container, and a brake, the projectile insertable into and ejectable from the elongated barrel, the reel mounted to the body proximate the front end.

13. The line launcher of claim 12, wherein the elongated barrel is removably coupled to the body at the front end.

14. The line launcher of claim 12, wherein the removable battery is removably coupled to the handle.

15. The line launcher of claim 12, wherein the compressed gas charge assembly comprises a motor, a compressor, and a pressure adjustor.

16. The line launcher of claim 12, wherein the compressed gas charge assembly comprises a motor, a compressed gas tank, a valve, a pressure level activator and a pressure adjustor.

17. The line launcher of claim 12, wherein the handle is a first handle and further comprising a second handle.

18. The line launcher of claim 12, further comprising a ram rod removably coupled to the elongated barrel.

* * * * *